US006398147B1

(12) United States Patent
Fredrickson

(10) Patent No.: US 6,398,147 B1
(45) Date of Patent: Jun. 4, 2002

(54) REEL WINDER

(76) Inventor: Jeremy W. Fredrickson, 8742 E. Mustang Trail, Scottsdale, AZ (US) 85258

( * ) Notice: Subject to any disclaimer, the term of this patent is extended or adjusted under 35 U.S.C. 154(b) by 0 days.

(21) Appl. No.: 09/596,816

(22) Filed: Jun. 19, 2000

Related U.S. Application Data

(60) Provisional application No. 60/176,849, filed on Jan. 19, 2000.

(51) Int. Cl.[7] ..... B65H 75/40

(52) U.S. Cl. ..... 242/390.8; 242/405.3; 242/597.4

(58) Field of Search ..... 242/390.8, 390.9, 242/405.3, 597.4, 597.6, 599.2, 129.7, 129.71, 129.72, 902

(56) References Cited

U.S. PATENT DOCUMENTS 2,055,039 A * 9/1936 Meisel ..... 242/599.2
2,727,702 A * 12/1955 Latincich ..... 242/597.4
3,647,155 A * 3/1972 Jorgenson ..... 242/902
4,915,320 A * 4/1990 Neal ..... 242/390.8
5,190,237 A * 3/1993 Fagan ..... 242/390.8
5,218,779 A * 6/1993 Morgan et al. ..... 242/902
5,277,350 A * 1/1994 Thornby ..... 242/390.8
5,947,790 A * 9/1999 Gordon ..... 242/390.8
6,244,011 B1 * 5/2001 Gavaza ..... 242/597.4
6,260,785 B1 * 7/2001 Prais ..... 242/390.8

FOREIGN PATENT DOCUMENTS

WO WO 93/09667 * 6/1993 ..... 242/902

* cited by examiner

*Primary Examiner*—John M. Jillions
(74) *Attorney, Agent, or Firm*—Gregory J. Nelson

(57) ABSTRACT

A winder for cord or line attachable to a power drill. The winder has a handle which rotatively supports a shaft having a threaded section. A pair of conical seat members are slidable on the threaded section to engage the core of a reel. A retainer such as a wing secures the seat members and reel in place. The user may hold the handle with one hand while operating the power tool to cause the reel to be rotated in a direction to take up the line. The conical seat members adapt the winder to use with reels of varying core diameter.

8 Claims, 2 Drawing Sheets

REEL WINDER

REFERENCE TO RELATED APPLICATION

This application is based on Provisional Application Ser. No. 60/176,849, filed Jan. 19, 2000, titled "Reel Winder."

FIELD OF THE INVENTION

The present invention relates to a reel winding device and more particularly relates to a device for taking up line or cable on a reel which device attaches to the reel and may be driven by a motorized tool such as cordless drill.

BACKGROUND OF THE INVENTION

Rewinding tape, cord or line on a reel is a common practice. Such a procedure may be practiced as a part of a recreational activity such as flying a kite or may be done in the construction trades. For example, when wiring a building or residence, electricians will often extend a guide line called "true tape" through an electrical conduit using a suction device. The "true tape" is light weight and may be attached to a guide wire or line which may then be pulled through the conduit. The guide wire line can be attached to electrical cable to pull a cable through the conduit. Retrieving or rewinding the "true tape" or string from an electrical conduit is generally done manually and the electrician or the electrician's assistant must manually rotate a reel or reel to rewind the "true tape" or string. Since it is not unusual for hundreds of feet of the tape or line be extended, the rewinding of the string or tape on a small reel or reel is a laborious and time consuming operation.

The same is true of rewinding other types of string and cable as for example string or cable that may be used in construction, surveying and marking or delineating areas such as those to be excavated.

In view of the foregoing, there exists a need for an efficient and speedy way of retrieving a tape, string or cord, by rewinding it on a reel or reel for storage and subsequent reuse.

BRIEF SUMMARY OF THE INVENTION

Briefly, the present invention provides a winder for taking up cord, line, tape or reel. The device is usable with conventional reels having a center spool with a hollow core. The device of the present invention includes a generally cylindrical handle which can be conventionally gripped by one hand of the user. The handle houses bearings at both ends which rotatively support an axially extending shaft. The outer end of the handle is enclosed by protective cover or a cap. The shaft has a threaded section which extends beyond the inner end of the handle and a pair of conical seat members are slidally disposed on the threaded section. The conical seat members are positioned so that their smaller, truncated ends are disposed facing one another. A fastener, such as a wingnut is secured about the end of the shaft. A reel can be positioned on the device by removing the wingnut and the outer most conical seat member. The reel is placed over the threaded rod and engaged with the inner seat member. The outer conical seat member is then inserted into the opposite side of the core of the reel and secured in place by the wingnut. The reel is then secured so that it rotates with the threaded shaft. The outer or distal end of the threaded shaft carries a section which has flat faces engageable with the chuck of a power tool such as a cordless drill. Thus the user can grip the handle with one hand, as for example, the user's left hand, and operate the power tool with the user's right hand causing the reel to be rotated in a direction to wind the attached cable or cord onto the reel.

BRIEF DESCRIPTION OF THE DRAWINGS

The invention will be better understood from the following descriptions and drawings in which.

DETAILED DESCRIPTION OF THE DRAWINGS

Figure 1:
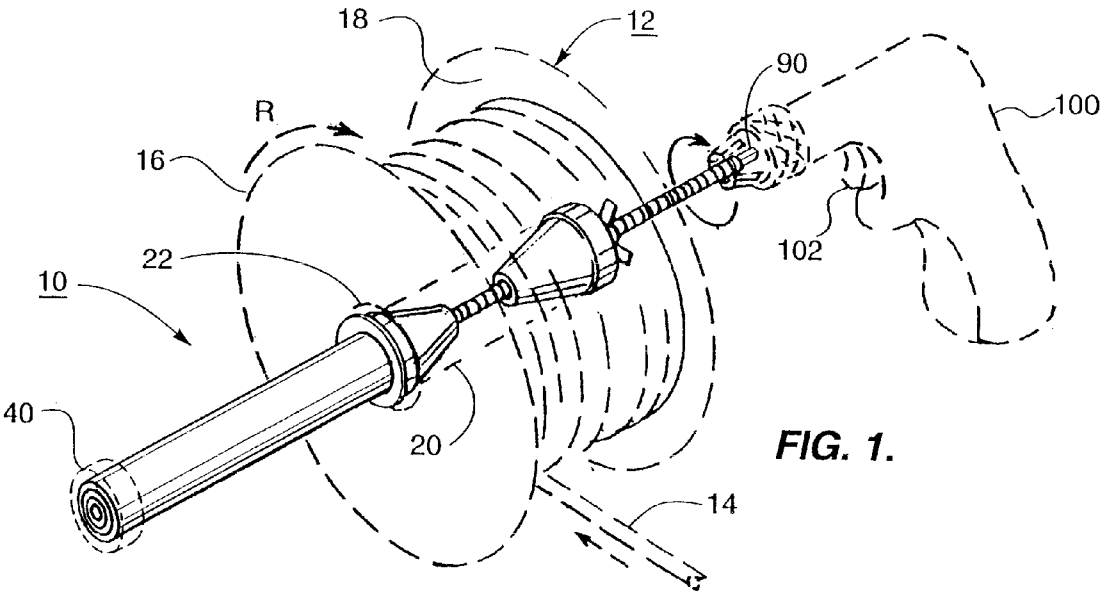
FIG. 1 is perspective use showing the winding device of the present invention secured to a reel shown in dotted and a power tool also shown in dotted lines.

Turning to the drawings, FIG. 1 shows the winding device 10 in connection with a reel 12. Reel 12 is representative of various types of reels for storing line and from which the line 14 may be payed out when used and rewound for storage and later use. The reel 12 has opposite sides 16 and 18 which are generally circular. A cylindrical spool 20 extends between the side walls 16 and 18 and has an open core 22 which extends within the spool.

The winding device or tool 10 has a generally cylindrical elongated handle 30 which may be fabricated from plastic but preferably is tubular steel approximately one inch in diameter by approximately six inches long. The handle is hollow and defines an axially extending channel 32. A first roller bearing assembly 34 is mounted at the outer or end of the handle. A second roller bearing assembly 36 is mounted within the channel 32 at the inner end of the handle. Although roller bearings are shown, any suitable bearing arrangement may be incorporated, such as journals, which support the shaft for rotation. The outer end of the handle 30 carries an end cap 40 which protects the bearing assemblies from dirt and contamination. The end cap 40 also serves as a retainer to prevent the user's hand from slipping from the end of the handle.

Shaft 50 is supported for rotation relative to the handle by the bearing assemblies 34 and 36. The portion of the shaft 50 within the handle 30 has a smooth cylindrical surface so it can freely rotate. The shaft 50 has a threaded portion 52 which extends or projects from the handle. The overall length of the threaded portion 52 may vary but is typically about ten to twelve inches in length. The shaft is retained in place by a washer 54 secured to the shaft 50 abutting bearing assembly 36 within the channel 32. When the device is assembled, shaft 50 with washer 54 secured to the shaft is inserted into the handle and through the bearing assembly 36. Once this is accomplished, the bearing assembly 34 can then be positioned about the inner end of the shaft and secured in place by conventional fastening techniques such as crimping the handle 30 about the bearings. However, it is preferred that the bearing assemblies 34 and 36 are secured in place by using a suitable adhesive such as an epoxy composition. Thereafter the end cap 40 is positioned over the opposite, proximal end of the cylindrical handle 30.

A pair of conical seat members 60 and 62 are slidably positioned on threaded shaft section 52. The seat members are essentially identical and each has a circular flange 65 and a body portion 66 which is tapered forming a generally truncated conical section. A bore 68 extends through the retainer so that the retainers may be positioned on threaded shaft section 52 so as to allow them to be axially adjusted. It is preferred that the relative diameter is of bore 68 and threaded shaft section 52 are selected so that the seat members are snugly positioned on the shaft without excessive clearance.

Figure 2:
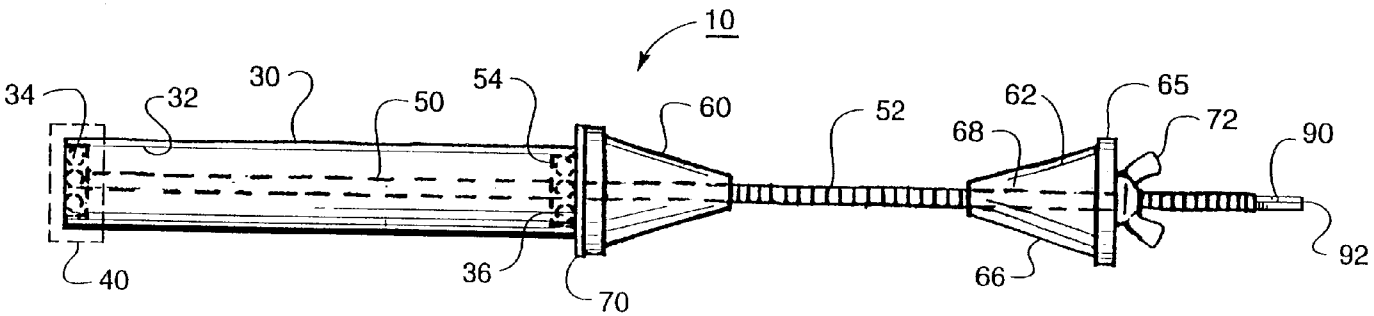
FIG. 2 is a longitudinal view partly in cross section showing the winding device of the present invention.
Figure 3:
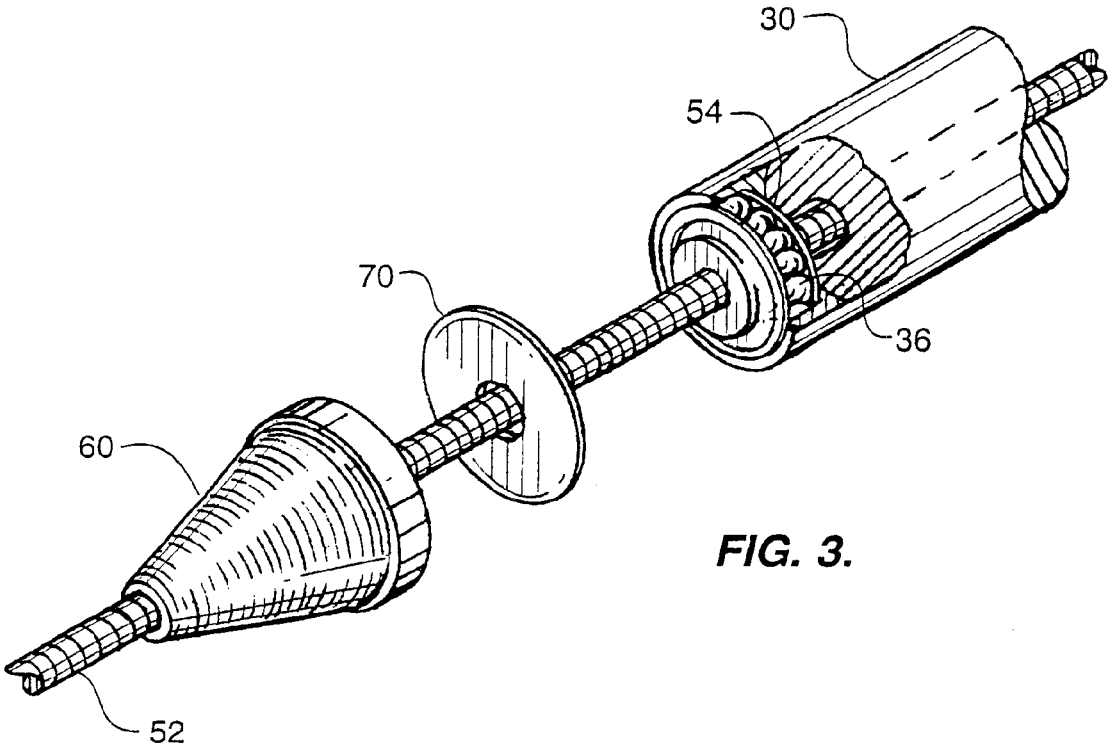
FIG. 3 is an enlarged perspective detailed view of a portion of the winding device.

In use, seat members 60 and 62 are positioned in opposed relationship as shown in FIG. 2 with the tapering conical body section adjacent one another. Preferably, a annular washer 70 would be interposed between the handle 50 and retainer 60. Wingnut 72 may be placed in threaded engagement with rod 52.

In use, a reel, such as reel 12, is positioned over the threaded shaft section 52, the retainer 60 and washer 70 having first been positioned on the threaded shaft section 52. The rod is then positioned on the shaft. The tapered body 66 of the seat member 60 and will engage the core of the spool 20 accommodating various core diameters ranging from approximately one-half to one inch in diameter. Seat member 62 is then placed on the shaft engaging the core of the reel. It will be apparent that the seat members 60 and 62 can be provided to the user in various sizes to accommodate spools having a greater range of core diameters. The wingnut 72 is then tightened so that the seat members are snugly engaged in the opposite ends of the core of the reel. Next, the length of the threaded shaft accommodates reels of varying width. A power tool 100, such as a cordless drill, is attached by its chuck to the outer end 90 of the threaded section 52. The outer end of shaft section 52 is formed having flat faces 92.

The line 14 is secured to the exterior of the core of the reel between the sides of the reel or reel. The user will then grasp the handle 10 with one hand and the power tool 100 with the other hand. The power tool is actuated by depressing the trigger or actuator 102 causing the shaft 50 and seat members 60 and 62 to be rotated in a direction shown by the arrow in FIG. 1 and indicated by the letter "R." This rotation will also impart rotation to the reel causing the line 14 to be wound onto the reel. This operation is continued until the reel is full or the line 14 fully retrieved. Once this is accomplished, the wingnut 70 can be loosened and seat member 62 removed to allow a reel to be removed for storage and later use.

Accordingly, the present invention provides a winder or rewinder device which is simple to manufacture, convenient and easy to use and effective for its intended user. The winder may be usable by contractors, construction personnel and particularly would be useful to electricians to wind and retrieve line or cord used when running electrical conductors.

It will be obvious to those skilled in the art to make various changes, alterations, and modifications to the invention described herein. To the extent those changes, modifications and alterations do not part from the spirit and scope of the invention disclosed, they are intended to be encompassed therein.

I claim:

1. A winder for line reels of the type having a hollow core for use, said winder comprising:

(a) a handle having an exterior surface and defining a hollow interior and having opposite first and second ends;

(b) a shaft rotatively secured to said handle and extending axially from said handle at said second end;

(c) a pair seat member slidable on said shaft, said seat members each having an outer surface adapted to seat in reel cores of varying diameter;

(d) fastener means for securing said seat member in said core; and (e) attachment means for securing said shaft to a power tool whereby said handle is held by the user and said shaft is rotated by said power tool to take in said line.

2. The winder of claim 1 wherein said seat members have a generally conical outer surface positioned in facing relationship in a position of use.

3. The winder of claim 1 wherein said handle is generally cylindrical.

4. The winder of claim 1 wherein said handle has a cap at said first end.

5. The winder of claim 1 wherein said shaft extending from said handle at said second end is threaded.

6. The winder of claim 1 wherein said shaft is rotatively secured to said handle by bearings in said hollow interior.

7. The winder of claim 5 wherein said fastener means comprises a wing nut.

8. The winder of claim 1 wherein said attachment means comprises flat faces engageable in a chuck of a power tool.

* * * * *